US005606777A

United States Patent [19]

Lu

[11] Patent Number: 5,606,777

[45] Date of Patent: Mar. 4, 1997

[54] CLIP

[76] Inventor: Chaio-Lan Lu, No. 7-7, 4 Lin, Chang-An, Hukou Hsiang, Hsin-Chu, Taiwan

[21] Appl. No.: 524,793

[22] Filed: Sep. 7, 1995

[51] Int. Cl.[6] ..... B42F 1/00; A44B 21/00

[52] U.S. Cl. ..... 24/67.9; 24/67 R; 24/545

[58] Field of Search ..... 24/67.9, 67 R, 24/67.3, 67.7, 3.11, 3.12, 545, 546, 346

[56] References Cited

U.S. PATENT DOCUMENTS

| | | | |
|---|---|---|---|
| 2,184,569 | 12/1939 | Stewart | 24/67 R |
| 2,478,376 | 8/1949 | De Swart | 24/67.9 |
| 2,566,837 | 9/1951 | Huelsmeyer | 24/67 R |
| 4,055,874 | 11/1977 | Brown | 24/67.9 |
| 4,226,006 | 10/1980 | Toyama | 24/3.12 |
| 4,332,060 | 6/1982 | Sato | 24/67.9 |
| 4,619,020 | 10/1986 | Lecher, Sr. | 24/3.12 |
| 5,113,554 | 5/1992 | Gallo et al. | 24/545 |

*Primary Examiner*—Victor N. Sakran

[57] ABSTRACT

A clip made of a springy plate by stamping for fastening sheets of paper together, having a bottom wall, a top wall obliquely suspended above the bottom wall, and an upright stop wall connected between the bottom wall and the top wall, wherein the bottom wall has a front end terminating in a downwardly sloping paper guide and the top wall has a longitudinal reinforcing rib in the middle and a front end terminating in an upwardly sloping paper guide, and defines two side openings above the bottom wall for access by the fingers of a user.

5 Claims, 4 Drawing Sheets

CLIP

BACKGROUND OF THE INVENTION

The present invention relates to clips for holding sheets of paper together, and relates more particularly to such a clip which can be conveniently opened by hand for mounting the sheets of paper to be fastened.

FIG. 9 shows a prior art spring clip for holding sheets of paper together. This spring clip comprises a base plate, a top clamping plate suspended above the base plate, a vertical stop wall connected between the top clamping plate and the base plate at one end, and a paper guide extending obliquely upwardly extended from the top clamping plate remote from the vertical top wall, for guiding sheets of paper into position. This spring clip is inconvenient in use, because its arm of force is short, and a special instrument is needed to apply the spring clip to a stack of sheets of paper.

SUMMARY OF THE INVENTION

The present invention has been accomplished to provide a clip which eliminates the aforesaid drawbacks.

According to one aspect of the present invention, a clips made of a springy plate by stamping for fastening sheets of paper together, the clip having a bottom wall, a top wall obliquely suspended above the bottom wall, and an upright rear wall connecting the rear ends of the bottom wall and the top wall, wherein the top wall has a front end passing over the front end of the bottom wall, and defines at least one side opening above the bottom wall. Therefore, the top wall and the bottom wall can be easily moved apart by fingers to open the mouth between for loading the sheets of paper to be fastened.

According to another aspect of the present invention, the top wall has a front end terminating in an upwardly sloping paper guide, and the bottom wall has a front end terminating in a downwardly sloping paper guide. Therefore, sheets of paper can be conveniently guided into position and clamped between the top wall and the bottom wall.

DETAILED DESCRIPTION OF THE PREFERRED EMBODIMENTS

Figure 1:
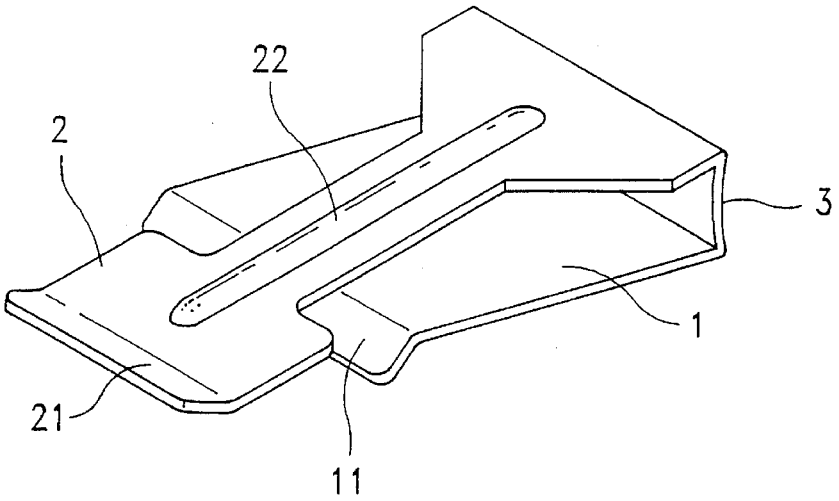
FIG. 1 is an elevational view of a clip according to the present invention.
Figure 2:
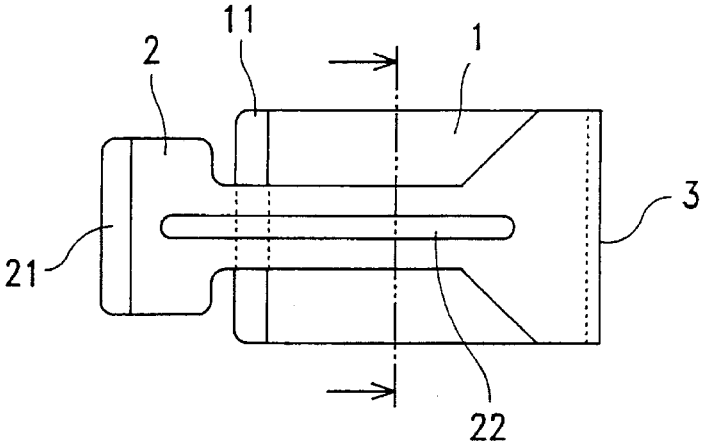
FIG. 2 is a top view of the clip shown in FIG. 1.
Figure 3:
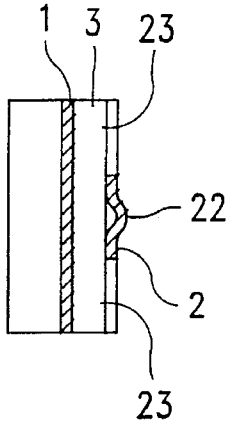
FIG. 3 is a cross sectional view of FIG. 2.
Figure 4:
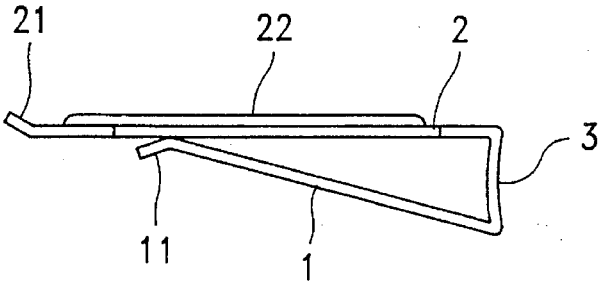
FIG. 4 is a side view of FIG. 1.

Referring to FIGS. 1, 2, 3, and 4, a clip in accordance with the present invention is made from a springy metal plate by stamping, and is comprised of a flat bottom wall 1, a flat top wall 2, and an upright stop wall 3 connected between the horizontal bottom wall 1 and the oblique top wall 2 at one end. The height of the stop wall 3 limits the thickness of the objects to be fastened. Viewing from one side, the bottom wall 1, the top wall 2, and the stop wall 3 form a triangular configuration (see FIG. 4). The top wall 2 slopes downwardly forwards from the top side of the upright stop wall 3 and passes over the front end of the bottom wall 1, the top wall having a longitudinal reinforcing rib 22 in the middle. The front end of the bottom wall 1 is disposed in contact with the bottom side of the top wall 2 and terminates into a downwardly sloping paper guide 11. The front end of the top wall 2 terminates forwardly of the front end of the bottom wall 1 in an upwardly sloping paper guide 21 and a front portion for guiding sheets of paper into position. As illustrated in FIG. 2, the top wall 2 is a substantially T-shaped member suspended above the bottom wall 1, therefore two open spaces 23 are defined above the bottom wall 1 at two opposite sides of the top wall 2 (see FIG. 3) for access by the fingers of a user.

Figure 5:
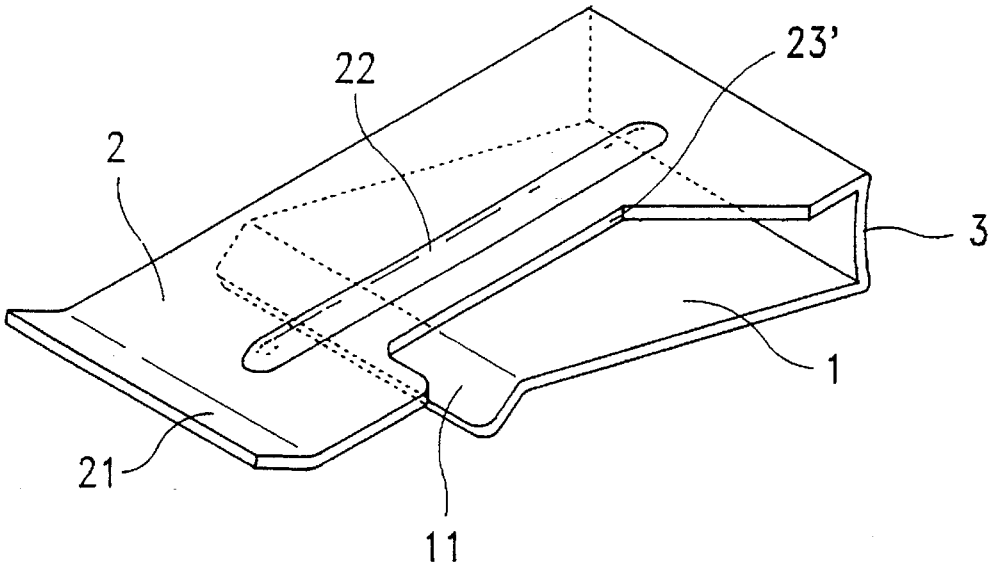
FIG. 5 shows an alternate form of the clip according to the present invention.

FIG. 5 shows an alternate form of the present invention. According to this alternate form, the clip is also comprised of a flat bottom wall 1 having a downwardly sloping paper guide 11, a flat top wall 2 having a longitudinal reinforcing rib 22 in the middle and an upwardly sloping paper guide 21 at the front end, and an upright stop wall 3 connected between the bottom wall 1 and the top wall 2 at one end. However, the top wall 2 is of trapezoidal shape, having a side opening 23' for access by the thumb of the user when the clip is held in the hand.

Figure 6:
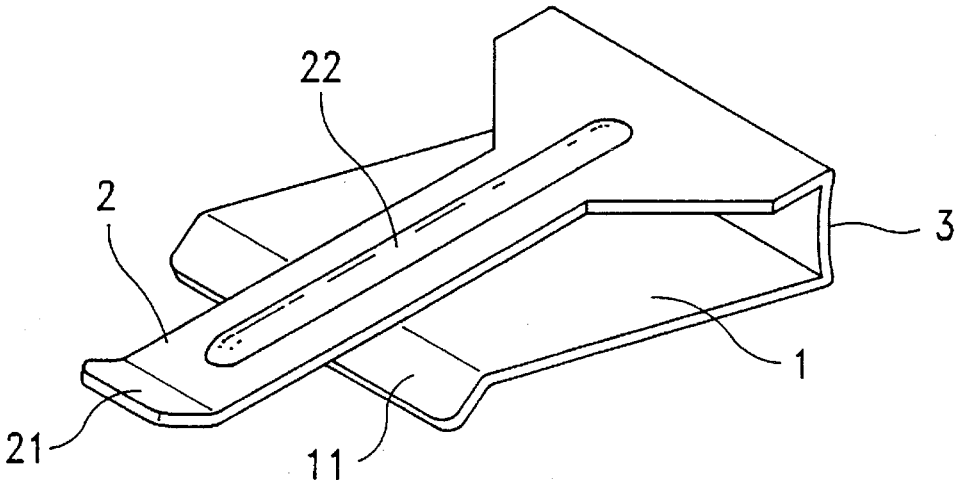
FIG. 6 shows another alternate form of the clip according to the present invention.

FIG. 6 shows another alternate form of the present invention. According to this alternate form, the clip is also comprised of a flat bottom wall 1 having a downwardly sloping paper guide 11 at the front end, a flat top wall 2 having a longitudinal reinforcing rib 22 in the middle and an upwardly sloping paper guide 21 at the front end, and an upright stop wall 3 connected between the bottom wall 1 and the top wall 2 at one and. However, the top wall 2 is shaped like a narrow strip of width smaller than the narrowest cross section of the bottom wall 1. Similar to the embodiment shown in FIG. 1, two open spaces are defined above the bottom wall 1 at two opposite sides by the top wall 2 for access by the fingers of the user.

Figure 7:
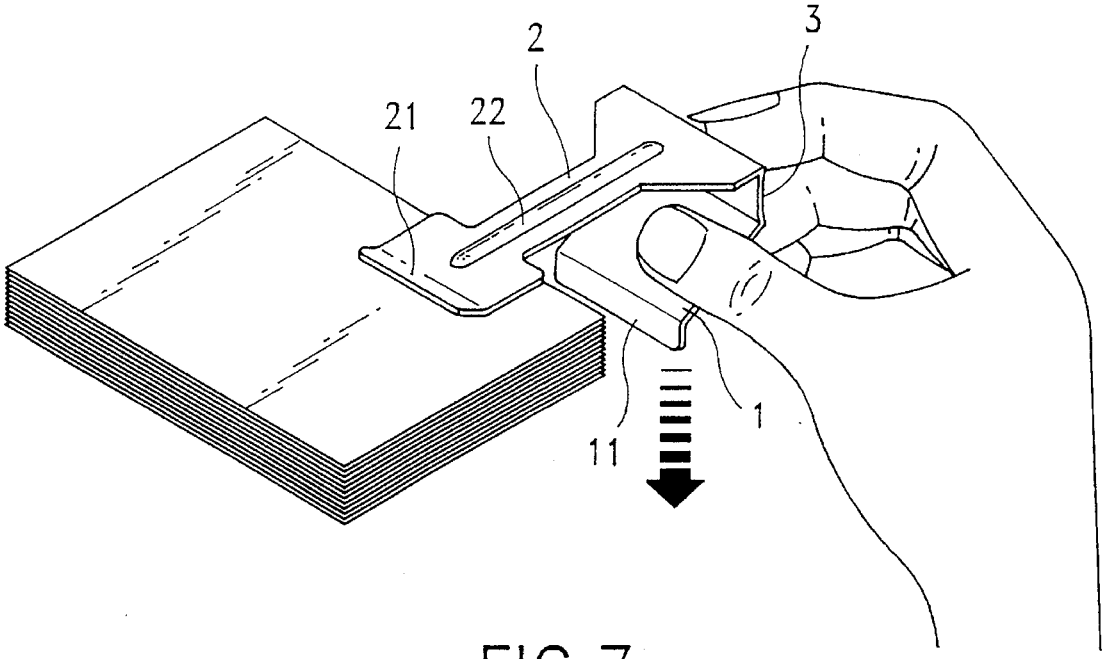
FIG. 7 is an applied view of the present invention, showing the clip opened.
Figure 8:
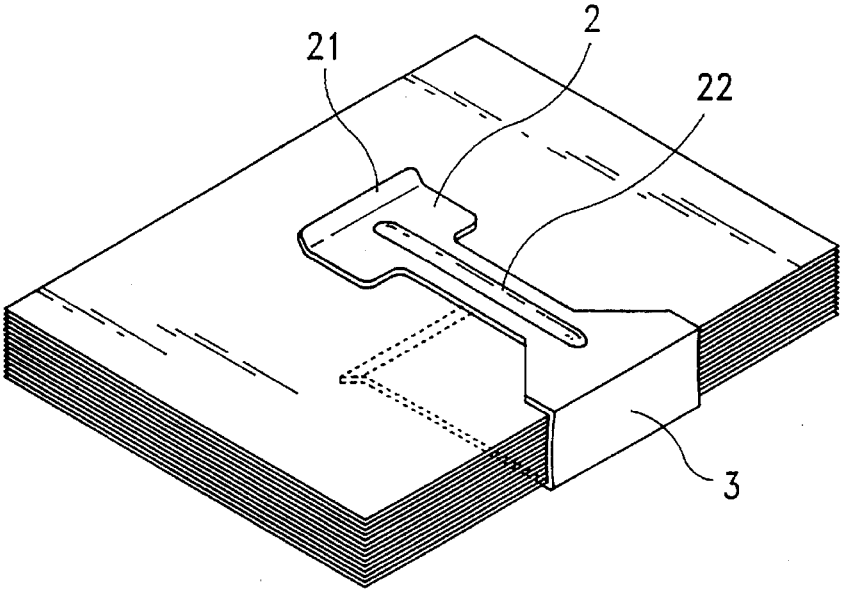
FIG. 8 shows the clip of FIG. 7 fastened to the stack of sheets of paper.
Figure 9:
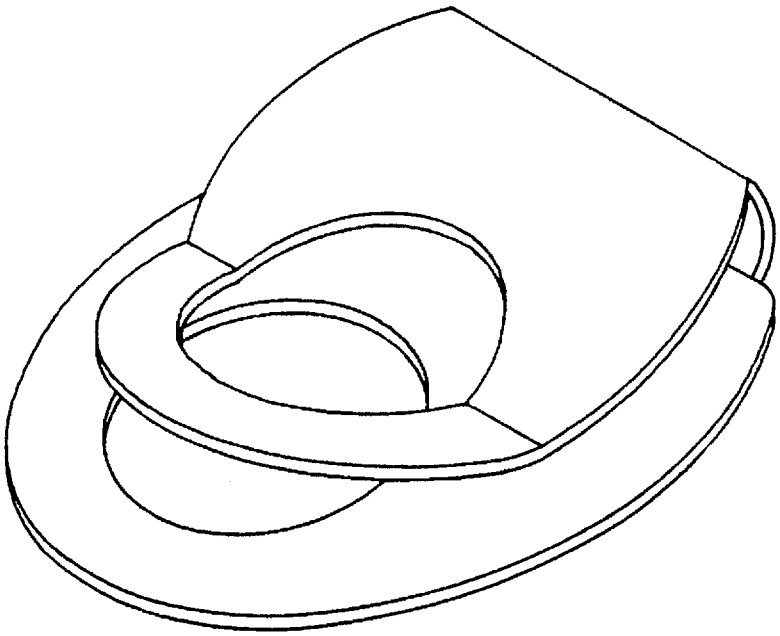
FIG. 9 (PRIOR ART)
FIG. 9 shows a spring clip according to the prior art.

Referring to FIGS. 7 and 8, when in use, the upwardly sloping paper guide 21 and the front portion of the top wall 2 are first engaged against the top side of the stack of sheets of paper to be fastened, then the bottom wall 1 is turned backward from the top wall 2, and then the clip is pushed forward into position, permitting the bottom wall 1 to be clamped on the bottom side of the stack of sheets of paper.

It is to be understood that the drawings are designed for purposes of illustration only, and are not intended as a definition of the limits and scope of the invention disclosed.

I claim:

1. A clip for fastening a stack of paper sheets together, the clip being stamp formed from a springy plate material and comprising:

a) a top wall having a pair of sides, a front portion terminating in an upwardly extending paper guide and a rear end;

b) a bottom wall having a front end terminating in a downwardly extending paper guide and a rear end;

c) a rear wall connecting the rear ends of the top and bottom walls and defining a substantially triangular configuration therewith, wherein the front portion and paper guide of the top wall both extend forwardly of the paper guide of the bottom wall; and d) at least one side of the top wall having an opening formed therein for access by a user to urge the bottom wall away from the top wall after the front portion and paper guide of the top wall are disposed in engagement with the paper stack, thereby permitting the paper stack to be received between the top and bottom walls of the clip and fastened together thereby.

2. The dip of claim 1 wherein each side of the top wall includes an opening.

3. The clip of claim 1 wherein the top wall is of a substantially I-shaped planar configuration.

4. The dip of claim 1 wherein the top wall is of a substantially T-shaped planar configuration.

5. The dip of claim 1 wherein the top wall includes a reinforcing rib extending longitudinally between the front portion and rear end thereof.

* * * * *